US007030777B1

(12) United States Patent
Nelson et al.

(10) Patent No.: US 7,030,777 B1
(45) Date of Patent: Apr. 18, 2006

(54) ROADWAY INCURSION ALERT SYSTEM

(75) Inventors: Craig Nelson, Elk Grove, CA (US); Robert E. Bos, Roseville, CA (US)

(73) Assignee: Logic Systems, Inc., Sacramento, CA (US)

( * ) Notice: Subject to any disclaimer, the term of this patent is extended or adjusted under 35 U.S.C. 154(b) by 389 days.

(21) Appl. No.: 10/289,230

(22) Filed: Nov. 5, 2002

Related U.S. Application Data

(60) Provisional application No. 60/337,035, filed on Nov. 6, 2001.

(51) Int. Cl.
*G08G 1/01* (2006.01)

(52) U.S. Cl. ..... 340/933; 340/907; 340/908; 340/908.1; 340/940

(58) Field of Classification Search ..... 340/907, 340/908, 933, 908.1, 940
See application file for complete search history.

(56) References Cited

U.S. PATENT DOCUMENTS

| | | | | |
|---|---|---|---|---|
| 2,099,868 | A | 11/1937 | Sing et al. | |
| 3,488,651 | A | 1/1970 | Brenner | |
| 3,660,817 | A | 5/1972 | Abrams | |
| 4,825,211 | A | 4/1989 | Park | |
| 4,951,045 | A | 8/1990 | Knapp et al. | |
| 4,998,093 | A * | 3/1991 | Benoit | 340/556 |
| 5,083,200 | A * | 1/1992 | Deffontaines | 348/148 |
| 5,128,670 | A | 7/1992 | Jackson et al. | |
| 5,175,529 | A | 12/1992 | St. Clair | |
| 5,265,556 | A | 11/1993 | Hall | |
| 5,281,964 | A | 1/1994 | Iida et al. | |
| 5,294,924 | A | 3/1994 | Dydzyk | |
| 5,378,865 | A | 1/1995 | Reneau | |
| 5,457,449 | A | 10/1995 | Kuning et al. | |
| 5,512,891 | A * | 4/1996 | Kang | 340/941 |

(Continued)

FOREIGN PATENT DOCUMENTS

GB 1503574 4/1975

OTHER PUBLICATIONS

Higginbotham, Keith et al.; "Road Crew Portable Laser Warning System Concept Development and Demonstration," U.S. Department of Commerce, National TEchnical Information Service, Publication No. PB97-143861, Cover Page, Report Documentation Page, Introduction p. 1 & 2, Table of Contents Page, pp. 1-17, Back Cover, Oct. 23, 1995.

*Primary Examiner*—Julie Bichngoc Lieu
(74) *Attorney, Agent, or Firm*—John P. O'Banion

(57) ABSTRACT

A system and method for generating remote incursion alerts in response to incursion detected by incursion transmitter units, such as at traffic cones, posts, barricades and signage. Alerts are generated in response to impacts detected at the safety icons within an incursion transmitter (or transceiver) and transmitted to one or more incursion receiver units which annunciate the alert with audio, lights, and or tactile output to warn construction crews of possibly impending danger. The alert signals may be communicated over a wired connection or a wireless communication link. Alert signals wirelessly communicated are preferably repeated by other incursion transmitters which are each coupled to a receiver to form a transceiver, wherein the distance and conditions over which the wireless alert signals may be communicated is extended. The incursion receiver may generate area alerts, or personal alerts, such as comprising the generation of audio, physical outputs, or light signals.

60 Claims, 6 Drawing Sheets

U.S. PATENT DOCUMENTS 5,577,824 A 11/1996 Wright
5,661,474 A 8/1997 Douglas
5,760,686 A * 6/1998 Toman ..... 340/540
5,900,826 A 5/1999 Farber
6,075,450 A 6/2000 Clark
6,288,651 B1 * 9/2001 Souza ..... 340/933

* cited by examiner

ROADWAY INCURSION ALERT SYSTEM

CROSS-REFERENCE TO RELATED APPLICATIONS

This application claims priority from U.S. provisional application Ser. No. 60/337,035 filed on Nov. 6, 2001, incorporated herein by reference.

STATEMENT REGARDING FEDERALLY SPONSORED RESEARCH OR DEVELOPMENT

Not Applicable

REFERENCE TO A COMPUTER PROGRAM APPENDIX

Not Applicable

BACKGROUND OF THE INVENTION

1. Field of the Invention

The present invention pertains generally to traffic safety devices, and more particularly to a method and system that provides remote alerts to roadway personnel in response to traffic incursions.

2. Description of the Background Art

Protecting road construction personnel from injuries that arise from vehicles straying from marked roadway boundaries or directives provided by safety icons has long been a high priority of various transportation organizations. It should be appreciated that safety icons may be provided in any of a number of different forms, including signage, safety barricades, safety barrels, safety nets, safety fences, traffic cones, traffic posts and so forth that are configured for directing traffic flow or displaying work site related warning signage and information. A number of systems have been developed toward fulfilling the goal of warning construction workers when a vehicle incursion occurs in association with these safety icons. For example, a number of light and sound devices have been proposed which attach to a traffic safety cone, or similar safety icon, for generating an alerting annunciation, such as light or sound, to warn construction personnel of a hazard when the safety icon is struck by a vehicle. Unfortunately, construction sites are often extremely high noise environments in which alerting sounds, and/or lighting, positioned more than a few yards away may not be noticed by busy construction crews. Further exacerbating the alert cognition problem, many workers wear noise attenuating hearing protection to minimize the noise hazard to which their ears are subjected.

As sound and light are attenuated in free space according to the square of the distance, it is also not surprising that the sound (or light) generated from a traffic cone alert device may only be recognized by personnel positioned within a short distance of the alert unit. The distance over which the warning may be heard, or seen, may be insufficient to allow workers to determine the cause of the alert and to extract themselves and others from danger. As a result, many workers are struck by oncoming vehicles every year. It should be appreciated that a number of causes may exist for highly erratic driving, for example the driver may be inept, out of control, intoxicated, asleep, in the throes of a physical situation (heart attack, stroke, and so forth), homicidal, suicidal, or combinations thereof along with other similar dangerous states of mind and/or body. Consequently, since existing systems can only reliably communicate warnings over a short distance, road construction personnel are subject to increased risk of injury or death.

Therefore, a warning system is needed that is capable of providing reliable incursion alerts to roadway personnel sufficiently in advance of when the oncoming vehicle poses a threat to construction workers located near the incursion or at any desired distance therefrom.

BRIEF SUMMARY OF THE INVENTION

The present invention is a roadway incursion system for generating incursion alerts to individuals that may be remotely located from the site of the incursion. The roadway alert system of the present invention generally comprises: (1) one or more incursion transmitter devices for communicating an alert signal in response to incursion, such as in response to incursion induced impact registration, or other form of detected incursion; (2) one or more incursion receivers which annunciate the received alert, such as by employing acoustic outputs, optical outputs, physically indicated alerts (i.e. "pop-up" flags or similar), tactile outputs, or combinations thereof.

The incursion detection devices may be configured for attachment to structures that may be positioned proximal to a roadway, and they communicate with one or more remote receivers over a wired connection, or over a wireless communications link. It will be appreciated that a wireless link allows for the flexible placement of the incursion detection units without concern for cord routing.

Considering a wireless implementation the devices may communicate using any desired form of communication link, such as within the electromagnetic radiation spectrum (i.e. radio, light), or acoustics (i.e. ultrasound). Since radio frequency communication is readily available and inexpensive it will be generally described herein, although it should be remembered that alternate forms of communication linkage may be utilized without departing from the teachings of the present invention.

Each incursion detector unit may be implemented as either a transmitter or a transceiver. Implementing an incursion detection device as a transceiver can provide additional benefits, wherein selective repeating of the incursion alert signals from other incursion transmitters or transceivers toward at least one incursion receiver unit can be performed to extend the range of communication. Using transceiver units as repeaters is beneficial in that the incursion detectors reporting to a receiver may span an extended distance while being less subject to signal loss because of terrain or other obstructions. Although the devices may be implemented as either transmitter units or transceiver units, the incursion sensing devices will be herein referred to as incursion transceivers.

Optionally, the incursion transceivers may include a local area signaling device, such as a light output, or sound, making it easier for workers to determine which incursion transceiver is generating, or generated, a particular alert as annunciated by an incursion receiver unit.

The incursion transceivers employ an incursion detector coupled with a transmitter or transceiver which remotely communicates incursions to additional transceivers and to a remote receiver. Incursion transceivers may be retained near roadway surfaces either as separate integrated units or attached to other roadway elements, such as traffic icons which may comprise signage, traffic cones, traffic posts, traffic barricades, and so forth. The transceivers may be configured to detect an incursion in response to an incursion related impact whose force is coupled to the transceiver, or the incursion transceivers may be configured to detect remote incursion events. For example, one form of incursion transceiver can be integrated within, or attached to, traffic cones and similar devices, to register and transmit alerts associated with impact. Alternatively, an incursion transceiver may be configured to detect physical incursion, impact, and so forth that occurs remotely. For example, an incursion transceiver may be configured with an optical detection beam that can directly register vehicle motion in relation with the beam for detecting incursion, or detect reflections from a traffic icon or similar structure to detect incursions in response to remote impacts.

By way of example and not of limitation, each incursion transceiver may comprise a shock sensor, a signal processing means, a control circuit, and a transceiver. The operational functions and features of the units may be readily controlled by conventional control circuitry, such as firmware executing on an inexpensive microcontroller. The incursion receiver unit may be configured to annunciate alarms to personnel within a given area, wherein it is generally referred to herein as a master receiver. The incursion receiver unit may also be implemented as individual "personal receivers" such as headsets, "walkie-talkie" units, or personal pager style devices that generate alerts to each individual wearing the device. It will be appreciated that a receiver unit retained on an individual may also be configured to generate an area alert, such as a walkie-talkie, headset, or pager, that is adapted with an external area annunciator (i.e. acoustic and/or light) output. The master receiver and personal receivers may be utilized separately or in combination with one another.

An object of the invention is to generate alerting indications to roadway personnel sufficiently in advance of possible bodily impact.

Another object of the invention is to provide an incursion alerting device that is substantially immune to being falsely triggered by winds, low batteries, and other non-incursion events.

Another object of the invention is to provide an incursion alerting device that may be implemented inexpensively.

Another object of the invention is to provide an incursion alerting device that may be implemented from readily available parts.

Another object of the invention is to provide roadway icon alert devices that are easily maintained.

Another object of the invention is to provide an incursion alerting device that utilizes vibration sensing, acceleration sensing, or other motion sensing elements capable of detecting impacts associated with vehicle incursion.

Another object of the invention is to generate alert indications which may be readily recognized by personnel working within a high ambient noise construction environment.

Another object of the invention is to annunciate incursion alerts upon individuals, such as those wearing a headset, walkie-talkie, or a pager configured for annunciating the incursion alert signal.

Another object of the invention is to provide roadway alert transceiver units in which an alert generated by one alert transceiver unit may be repeated by nearby alert transceiver units for communication to a remote receiver configured to annunciate the alert proximal to roadway construction workers.

Another object of the invention is to prevent unlimited radio frequency signal regeneration within the alert units.

Another object of the invention is to provide an incursion alert transceiver unit for remotely communicating alerting indications to a remote location.

Another object of the invention is to provide an incursion alert transceiver unit in which predetermined unit type parameters, and identifiers, along with a selected message are communicated from an alert transceiver unit to an alert receiving unit.

Another object of the invention is to provide an alert communicating system that utilizes transmissions within the electromagnetic spectrum for communicating alert signals from a transmitter at a location associated with a vehicle incursion to a remote location at or nearby roadway construction workers that may be endangered by the erratic driving associated with the incursion.

Another object of the invention is to detect and communicate low battery conditions (or the possible weakness or failing of other forms of power sources) so that remedial action may be taken early to assure reliable operation of the alert system.

Another object of the invention is to provide a remote alert system having a low power dissipation factor that can provide extended operating periods from small inexpensive power sources, such as batteries.

Further objects and aspects of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 7. It will be appreciated that the apparatus may vary as to configuration and as to details of the parts, and that the method may vary as to the specific steps and sequence, without departing from the basic concepts as disclosed herein.

Figure 1:
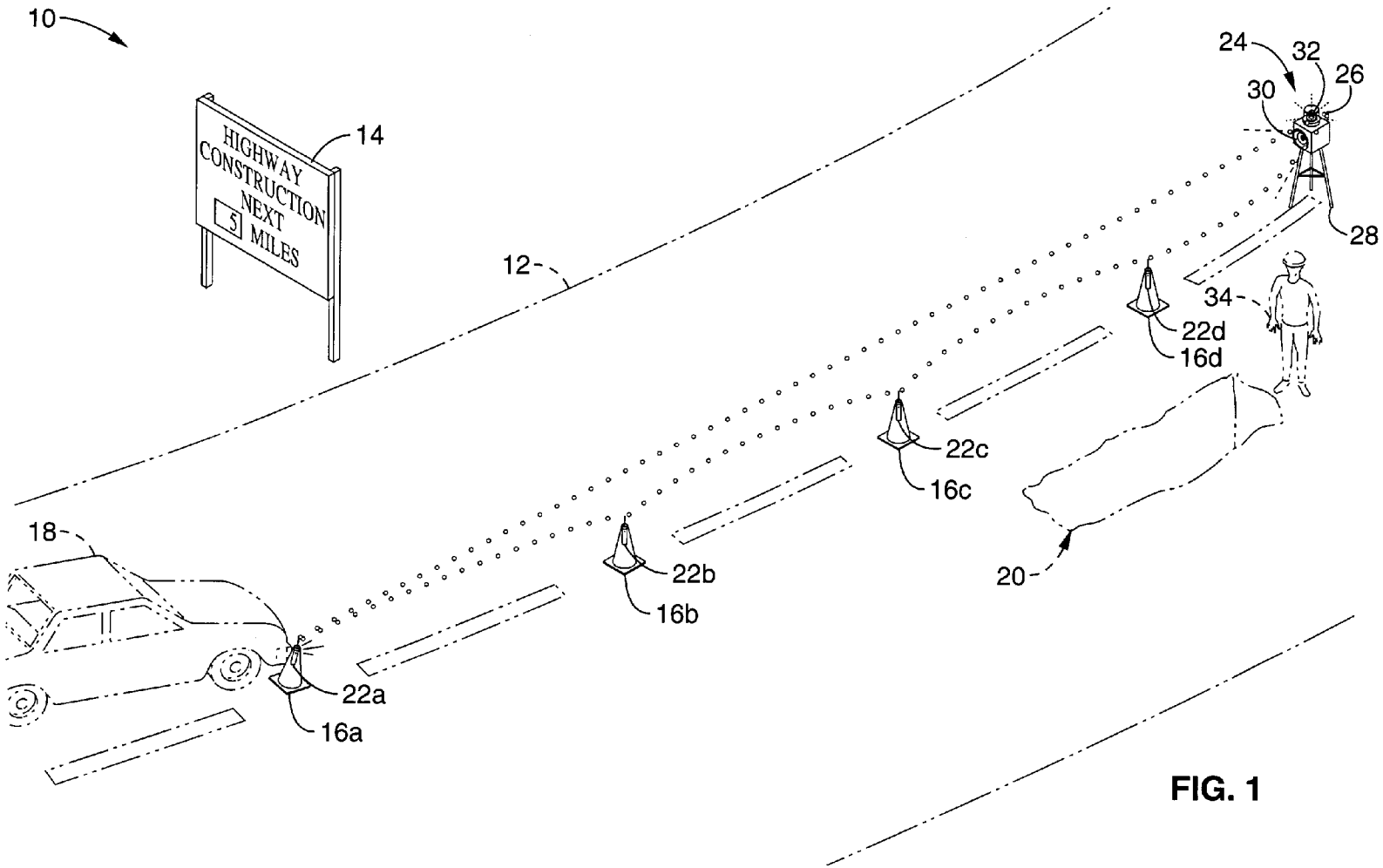
FIG. 1 is a diagram of a roadway situation in which an incursion alert system according to an embodiment of the present invention is shown for alerting personnel, such as roadway construction workers, in response to the danger associated with remotely detected incursions.

FIG. 1 exemplifies a typical roadway construction situation 10, showing a roadway 12 with a construction sign 14 and a series of traffic cones 16*a*–16*d* blocking off a closed lane. The sign 14 and cones 16 are examples of typical safety icons for routing and controlling vehicular traffic. In this situation, a vehicle 18 is shown impacting cone 16*a*, which may be considered as an incursion of the vehicle into the closed lane providing a safety zone for the roadway workers near construction area 20. Usually such incursions are the result of a driver being slightly off-course, however, an erratic or impaired driver may cross over and continue on a course toward the construction crew.

It will be appreciated that such hazards may arise from a number of different arrangements and situations in which safety icons provide demarcation of traffic flow paths. Typically, the present invention would be utilized to provide a warning to workers in an area near these safety icons in response to the detection of incursions, such as that depicted in FIG. 1. Prior alert systems have generally provided local audio or visual alert annunciation having a range that is limited to a location adjacent to the detected incursion. In many cases these alerts may be seen or heard by one or all of the workers and the incursion may quickly lead to collisions with possibly dire consequences. This is not surprising in that construction sites are often subject to high noise levels wherein only nearby annunciations can reliably warn work crews. In addition, road crews are often busy doing the task at hand and may not be in a position to see a signal light located many yards away.

The present invention detects an incursion within an incursion transceiver unit 22. A series of incursion transceiver units 22*a* through 22*d* are depicted in FIG. 1 mounted to a series of safety icons, exemplified as traffic cones 16*a* through 16*d*. The incursion transceivers are depicted being utilized with traffic cones (or posts) as these are perhaps the most common forms of safety icons utilized for separating traffic from roadway crews. Each incursion transceiver unit 22 is preferably retained within a housing that is configured for being removably mounted to a traffic cone 16, or other safety icon, such as by using a spring clip. It will be readily appreciated that any convenient mounting methodology may be utilized for attaching the incursion transceiver units 22 to a safety icon.

Alternatively, the incursion detection units may be integrated within safety icons, integrated within other devices to provide incursion detection, or mounted separately to detect remote incursions.

Each incursion transceiver unit 22*a* through 22*d* is configured to transmit alert signals over a distance, such as by radio frequency transmission or similar communication mechanism, to an incursion receiver unit 24. A series of dots represent the communication signal path between nearby incursion transceiver units 22*a* through 22*d*, and between transceiver units 22*a* through 22*d* and the receiver unit 24. For the sake of clarity only one path from transceiver unit 22*a* to receiver 24, and between successive incursion transceiver units is depicted. It should be appreciated, however, that each incursion transceiver can communicate with other transceiver units within its range as well as one or more receiver units.

The incursion receiver responds to these transmissions by annunciating alerts to personnel. It should be appreciated that other forms of transmission, such as optical (i.e. infrared, visible, ultraviolet), acoustical (i.e. ultrasonic), or similar transmission media can be adapted to provide communication between incursion transmitter units and one or more receiver-annunciator unit. The present invention may be implemented to generate both area alerts and individual alerts, such as noise attenuating headsets, walkie-talkie, and pager style devices.

Incursion receiver unit 24 is configured within this embodiment to annunciate area alerts to personnel in response to signals received on antenna 26. The area alerting receiver unit 24 may also be referred to herein as a master receiver. Preferably, receiver unit 24 is supported on a base 28 which retains the unit above the ground for improved sound dissemination and increased light source visibility. Alerts may be annunciated as an audio output, signaling lights, physical output (i.e. "pop-up" flags), tactile output (haptic output), or combinations thereof.

In the present embodiment, incursion receiver unit 24 is configured for generating both a loud audio warning signal from audio transducer 30, and a bright flashing light generated by signaling light 32. The remote signaling capability increases the likelihood that a roadway construction worker 34 will hear and see the alert even if it is generated from a remote incursion, wherein increased maneuvering time is provided for protecting themselves and others. Additionally, the master receiver may be coupled with or incorporated within existing equipment, such as within radar-equipped vehicle speed annunciating signage, or other devices.

Figure 2:
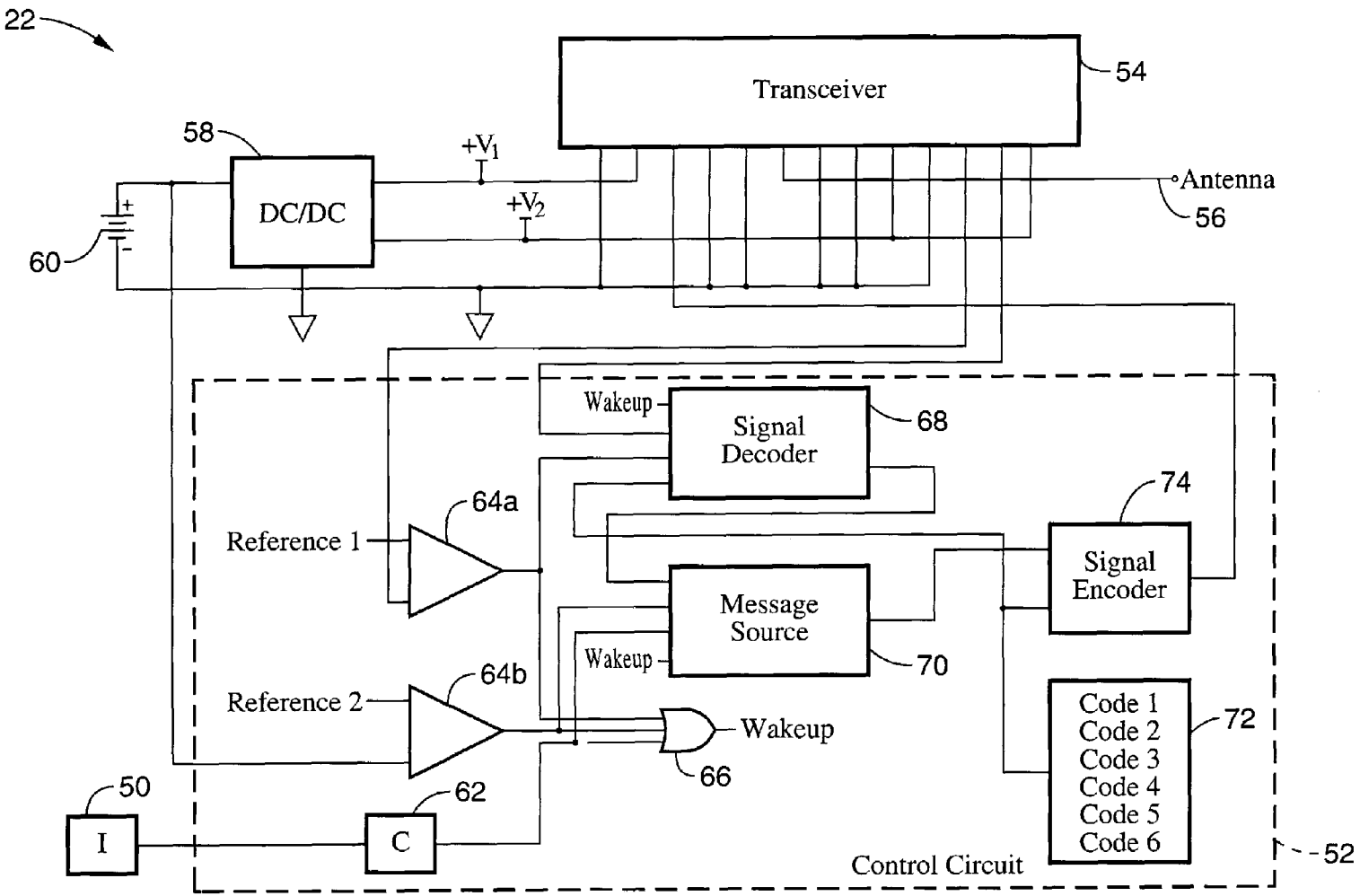
FIG. 2 is a simplified schematic for an incursion transceiver unit according to an embodiment of the present invention shown for detecting impacts as incursion events.

FIG. 2 exemplifies an incursion transceiver 22 which is configured to detect and broadcast impact events as incursion transmissions. The transceiver of the present invention is preferably configured for retransmitting incursion events broadcast by other nearby incursion transceivers. Incursion transceiver 22 generally comprises a housing (not shown) within which are retained an incursion detector 50, control circuit 52, transceiver 54, antenna 56, a voltage regulator 58, and power source 60. An automatic power switch (not shown) is preferably provided to allow turning off the units when not in use. It should be appreciated that incursion transceiver 22 may be positioned for use in any of a number of desired configurations, including: (1) standalone use; (2) having a housing configured for mounting to a structure, such as a safety icon; (3) integrated within a safety icon, or other structure.

Incursion detector 50 may comprise any form of sensor capable of registering incursion. A common and easily detected form of incursion arises when a vehicle strikes a safety icon, wherein impact registration can be utilized as an indicator of incursion. By way of example, pressure sensors, impact sensors, tilt sensors, motion sensors, force sensors, speed sensors, distance sensors, rate of rotation sensors, vibration sensors, or acceleration sensors, may be utilized to detect impacts associated with incursion events. These sensors may comprise simple switch type devices or comprise one or more sensing elements coupled with signal conditioning and/or processing circuitry. The sensor may be implemented using any convenient technologies and fabrication processes including piezoelectric, MEMs, and so forth. It will be appreciated that the response of the sensor need not provide high accuracy or a linear output.

Piezoelectric thick film vibration sensors are generally preferred herein because of their inherent low cost. An example of one such sensor is model "0-1002794-1 Switch/Vibration Sensor" manufactured by Measurement Specialties™ of Valley Forge, Pa. This device comprises a thin piezoelectric PVDF film laminated to a flexible planar substrate. One end of the substrate is attached (i.e. through its two electrical contacts) while the other end is free to move in a cantilevered single axis manner in response to impact vibrations or accelerations. The baseline sensitivity of this particular sensor may be varied from approximately 50 mV/g to approximately 800 mV/g by adding small masses to the free end of the sensor. A number of sensor types are readily available which may be alternatively utilized for registering the vibrations or accelerations associated with a vehicle impact. It should be appreciated that contact switches and pressure sensors may also be utilized, wherein a mass element applies pressure to the sensor in response to an impact. Alternative forms of sensors may also be utilized as outlined previously.

Transceiver 54 preferably comprises a low cost radio-frequency (RF) transceiver configured to operate within any desired frequency range. RF sensitivity is preferably on the order of −92 dBm while preferred LF bandwidth should be about 2.5 kHz, with an output power sufficient for the desired range, such as approximately 10 dBm +/−2 dBm. Presently, there are two preferred ranges of frequency: from 260–470 MHz, and from 900–928 MHz. One preferential operating frequency is 433.92 MHz, such as embodied in transceiver model "ATXR-434-ULC Ultra-low Current SAW Transceiver" manufactured by ABACOM™ technologies in Ontario.

Incursion transceivers may be configured for operation over a single radio frequency and grouped according to a predefined code embedded in the signal. Alternatively, transceiver units may be designed to operate in groups, with each unit group operating on a separate frequency suitable for reception by the incursion receiver unit. It should also be appreciated that multi-channel, broadband, or signal hopping technology may be utilized, as well as other forms of communicating over a distance to a remote annunciating device without departing from the present invention.

The configuration of antenna 56 is generally determined by the intended range and desired directionality of the transmitter unit, along with packaging and reliability considerations. Typically, a non-directional antenna is preferred in that it is not subject to being misaligned with a receiver unit; however, a directional antenna may provide benefits in select applications (i.e. high traffic situation with numerous transmitter-receiver pairs). It should be noted that transmission distance is largely determined by the combination of transmitter output power and the gain of the particular antenna configuration. Generally, it is preferred that the incursion transceiver unit be configured for a transmission range of approximately 300 feet using a quarter-wave antenna unit, which has a length of around six inches for a 434 MHz transmitter. The antenna, however, may be altered to reduce transmission distance for use in crowded environments, or to increase transmission range if incursion detection is carried out over a larger span between safety icons.

Typical low cost data transmission modules, such as utilizing OOK data encoding, are readily available and provide data at up to about 19.2K baud, which is more than adequate for transferring the necessary alert signals, codes, and other information described herein. The data is preferably encoded following conventional serial communication protocols having at least five bits of encoded information per transmission. It is preferable that the transceiver (or transmitter) unit chosen for this application either be configured to generate alert transmissions which do not require FCC approval, or be pre-approved by the FCC to eliminate the necessity of obtaining FCC certification for the entire incursion transceiver unit.

The use of long life primary batteries can provide an inexpensive and readily obtained source of power for the incursion transceiver units. For example, power may be provided by utilizing primary batteries having a long shelf-life, such as alkaline, lithium, or similar long-life technologies contained within one or more AA, or AAA size, battery cells. The battery life preferably exceeds approximately 3000 hours and the units should be configured for having negligible power dissipation when not activated. A single battery cell may be utilized for driving low voltage circuitry, or more preferably it may be utilized in conjunction with a regulator that provides voltage multiplication, such as derived from one or more stages of switched capacitor voltage doubling.

Power may be alternatively provided with batteries in combination with other forms of power, such as solar cells charging a super capacitor or battery. Fuel cells and other alternative sources of power may also be utilized for providing requisite circuit power. In view of these examples, it should be appreciated that any convenient source of power may be adopted for use within the units without departing from the teachings of the present invention.

A preferred form of power switch is activated in response to the ambient light condition measured from a sensor such as a solar cell. When the excursion transceiver unit is exposed to a minimum level of ambient light the excursion transceiver unit will activate performing initialization and readying itself to monitor. When the ambient light is below a minimum level for a predetermined amount of time, 24 hours for example, the excursion transceiver unit will shut down all monitoring, except light level, thus preserving battery life.

Another option is to use a form of power switch that is activated in response to installation of the incursion transceiver antenna. The presence of an extended antenna can provide a beneficial visible clue that the incursion transceiver unit is activated, wherein units are less likely to be stored in an ON position thereby depleting battery power. To prevent loss of an antenna after disengagement from the housing, the antenna may be designed to retract, be joined to the housing by an articulated member such as a hinge, or be otherwise configured so that the antenna may be moved from an extended ON position to a substantially recessed, folded-back, or otherwise retained OFF position.

Additionally, it is preferable that incursion transceiver 22 provide an output means, such as an LED, audio transducer, or similar, for indicating the state of the particular transceiver unit, in particular when power is applied to the unit. By way of example and not of limitation, a bi-color LED may be driven for a short period of time following power activation to indicate unit state and the results from a unit self-test operation.

It will be appreciated that even a single bi-color LED can indicate numerous unit conditions, the following being provided by way of example: (1) displaying a solid green light to indicate a proper operational status; (2) displaying an intermittent green light in response to impact intensity during a portion of the self test so that impact sensor operation is visually verified; (3) displaying an amber light (fast alternating red and green at >30 Hz) for indicating a slightly weak battery; (4) displaying a solid red light to indicate a low battery condition; (5) displaying a flashing red light to indicate circuit failures, such as unable to loop back a transmission from transmitter to receiver, and/or a very low battery condition; (6) displaying a slow alternating red and green light output for a given period of time (i.e. one minute) after registering an incursion level impact to aid in isolating which unit was the source of a given alert signal as received by a master receiver or other receiver unit; (7) upon power up, the absence of light output would indicate that either the battery (or batteries) had discharged below required voltage levels or that the unit is otherwise in a non-operative condition. A legend is preferably provided on the transceiver unit to aid personnel in the interpretation of various unit state annunciation signals which may be generated by the incursion transceiver. The LED is preferably only activated for a limited period of time after power is applied to the unit so as to conserve battery power. It will be appreciated that a number of methods may be utilized for indicating the state of an incursion transceiver unit prior to, and during, its deployment at a work site without departing from the teachings of the present invention. Another example would be a portable hand held interrogation device, which may be used to indicate complete status of an intrusion transceiver unit when held in proximity to the unit being interrogated.

The circuitry shown is representative of the functions performed within incursion transceiver 22. It should be appreciated, however, that incursion transceiver unit 22 may be implemented in any number of ways, such as using discrete elements, custom integrated circuits, programmable logic elements, microcontrollers, other circuit elements and combinations thereof, without departing from the teachings of the present invention.

One preferred method of implementing control circuitry 52 is by utilizing an inexpensive microcontroller, such as a PIC™ microcontroller from Microchip Technology Incorporated® located in Chandler, Ariz. The microcontroller provides data memory (RAM), comparator inputs, embedded identification and/or code programming, and sufficient program memory (ROM, OTP, EPROM, FLASH) for retaining a control program to perform the desired logical functions, the self testing, and for controlling the operation of a transceiver.

Output from impact sensor 50 is received within control circuit 52 by way of conditioning circuit 62 which is configured to condition the signal, such as by pass-band filtering and signal amplification so as to eliminate unwanted signal noise and to desensitize the circuit to non-alert conditions (i.e. by effectively attenuating the signals associated with non-impact events such as, but not limited to wind or vibrations transmitted from the ground). Conditioning circuit 62 may also be utilized for validating the registered impact, for example by requiring that the impact exceed a predetermined amplitude prior to being registered as an incursion event. It will be appreciated that more complex validation circuits may be alternatively utilized, such as those which incorporate signal processing as may be executed by a microprocessing element, or are processed by means of other circuitry for providing either fixed or adaptable validation conditions.

The impact detection circuitry within incursion transceiver unit 24 preferably provides the ability to detect the difference between a wind blown disturbance and an impact disturbance. The above sections describe the use of fixed alert thresholds for discriminating impact events. However, it should also be appreciated that impact events may be alternatively registered using variable or adaptable thresholds. For example, the impact signal being generated may be compared to a relative base line impact level (i.e. running average of temporally-local peak impact intensity as generated by wind and other non-impact disturbances) to assure that ambient conditions do not trigger an alert. For example, the processor can determine if sufficient G force change has occurred to constitute an impact, such as 5 Gs, from a base line average of sensed gravity peaks arising from wind gusts. If for example periodic wind disturbances cause gravity response peaks of approximately 1 G, then a registered impact at that time would require 6 Gs before being considered an incursion event. This method allows unit sensitivity to be automatically optimized for different conditions, such as gusty wind conditions, so that false alarms may be prevented without unduly sacrificing sensitivity. It will be appreciated that numerous additional adaptive evaluation methods and algorithms are known in the signal processing arts which may be utilized herein without departing from the teachings of the present invention.

First and second comparators 64*a*, 64*b* are shown for determining if the signal from the transmitter is of sufficient magnitude to warrant waking up the incursion transceiver unit, and for detecting low battery conditions. The electrical signals corresponding to impact, low battery, and receiver activity are shown connected to a three input "OR" gate 66 whose output is shown driving a wakeup signal. A signal decoder section 68 provides for decoding signals from the receiver portion of transceiver 54 and determining whether or not the received incursion alert should be retransmitted. A message selector 70 provides a message selection means that is responsive to events within the device, or received from other devices. The logic within message selector 70 determines what, if any messages, are to be transmitted, such as transmitting an incursion alert from this unit, retransmitting an incursion alert signal received from another unit, transmitting a low battery condition, transmitting results during a self-test mode, and other possible message states. It should be recognized that a number of different messages may be encoded and communicated by each incursion transceiver unit to one or more incursion receivers.

A code section 72 is configured as a means for generating a predetermined data code within the transmitted alert signal. The code provides information about the transmitting source such as a unit identifier, a unit type specifier, or a transmitter group designation to be encoded into the transmissions. These codes can facilitate the proper processing of signals by incursion receiver units, such as the master receiver.

By way of example, assume a first group and a second group of transceivers are each set for encoding a different group code. The first group of transceivers may be setup at the work site associated with a first direction of traffic, while the second group of transceivers may be setup associated with a second direction of traffic. The incursion receiver, or receivers, may be configured for generating an annunciation for either direction, both directions equally, or for generating different annunciations depending on direction. Additionally, different incursion receiver units may be utilized for the first and second groups without confusion. Furthermore, the groups may be setup at different distances from a work site (i.e. first group from over 300 feet to 100 feet, second group spanning the last 100 feet) to provide different intensity annunciations with respect to distance. Accordingly, it should be appreciated that code based encoding may be utilized to provide any desired segmentation of the alert signal without departing from the present invention.

A signal encoder section 74 provides for incorporating (encoding) the codes and messages within a transmission by transceiver 54. In a preferred implementation, signal encoder 74 combines the value from the message selection logic with an embedded code to form the data to be transmitted. The embedded code preferably comprises a unique or semi-unique identifier, type code, or group code programmed into a microcontroller or other element able to retain coded data for transmission.

Each incursion transceiver unit 22, upon transmitting a message, preferably locks out its receiver for a period of time, such as from approximately 0.5 to 15 seconds, and more preferably for about 2 seconds, to prevent continuous alert transmissions from being generated. It will also be appreciated that more frequent alerts would typically prove to be more annoyance than benefit.

Incursion transceiver unit 22 may be implemented with a number of alternative configurations and utilized in various ways. The following information is provided by way of example illustrating a few of the contemplated variations. The use of incursion transmitters may be utilized instead of transceivers if the distance to the incursion transmitter units is less than the transmission range of the transmitters. If situations arise that require extending the operating distance beyond this nominal range then one or more repeater units (transceiver units or discrete receivers coupled to the transmitters may be added when setting up the safety icons. Furthermore, the incursion detection transmitters can be adapted for the attachment of various configurations of antenna to alter the gain and thereby to control the transmission range. Similarly, the antenna within the master receiver may be adjusted or replaced to suit the distance over which coverage is desired.

Other embodiments of the incursion transceivers are contemplated, for example, an embodiment may be implemented in which the transmitted message may include a severity code in response to the extent of the impact being registered. Encoding of severity can provide different forms of annunciation, for instance, in response to a backhoe working at the site gently bumping a traffic cone, as contrasted with a speeding vehicle overrunning a set of traffic cones as it careens toward a road crew. The type and intensity of alert annunciation may also be fully or partially responsive to the encoded value for unit type, group, and so forth as described earlier. Additionally, the annunciation severity may increase upon registering a subsequent impact by a second transceiver unit, after that second unit received the signal from the first transceiver unit. In this way a slight incursion of a vehicle with a single safety icon may be differentiated from an out of control vehicle that is crossing over a series of safety icons. Furthermore, receiver units may be configured to generate an annunciation whose characteristics are varied in response to the distance from the incursion transmitter generating the alert. It will be recognized that this approach allows communicating additional information to aid the work party in ascertaining risk factors.

Figure 3:
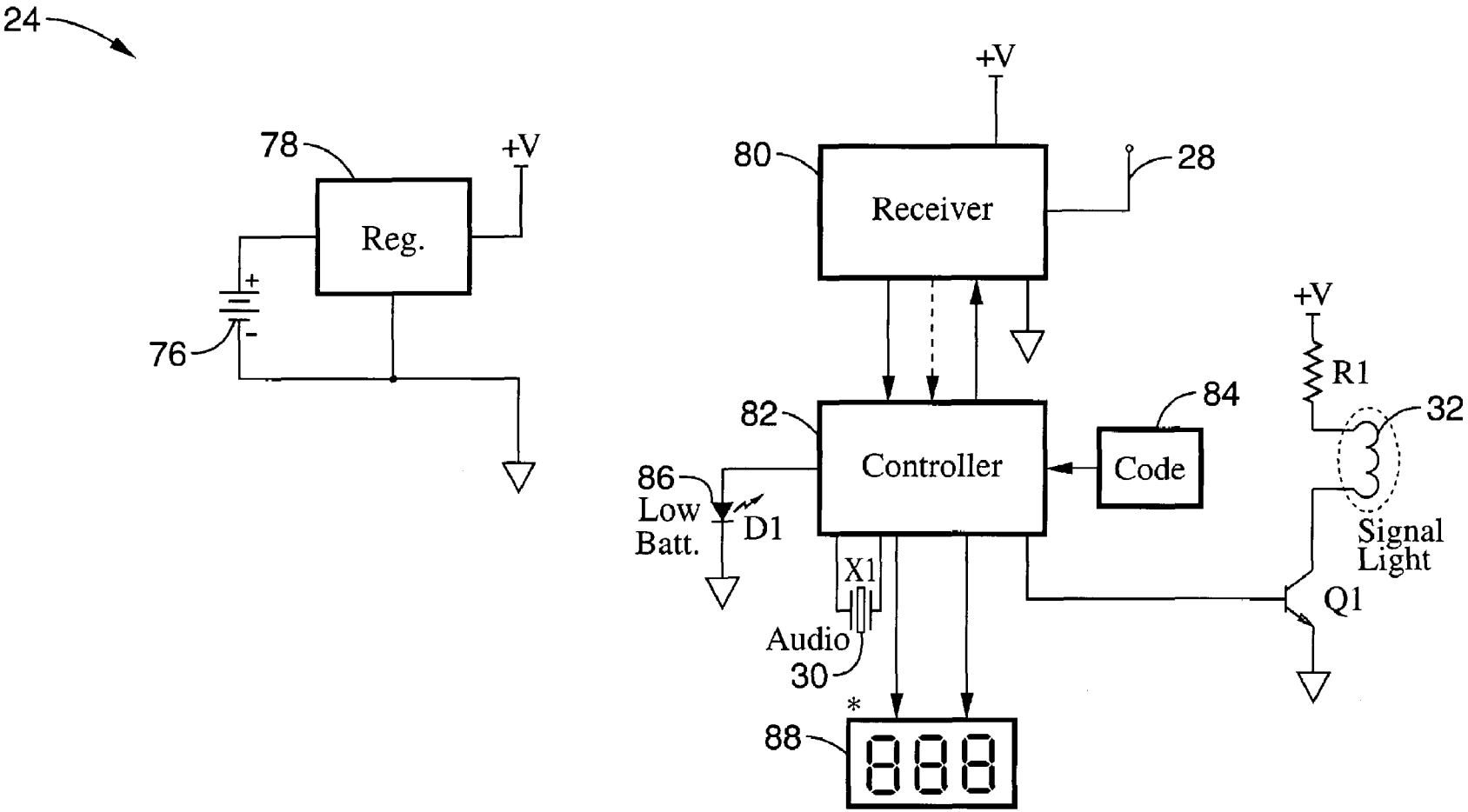
FIG. 3 is a block diagram of an incursion receiver according an embodiment of the present invention, shown configured for activating an audio transducer and a signal light in response to received alert conditions.

FIG. 3 exemplifies a simple embodiment of an incursion receiver unit 24. It should be appreciated that numerous forms of receiver devices may be designed or modified for use with the incursion transceivers of the present invention. The figure exemplifies one such receiver unit that converts radio frequency alert signals received from incursion transceivers into an annunciation of sufficient intensity to alert personnel in the area surrounding a master receiver unit, or other area alerting receiver. Alternatively, receiver unit 24 may be implemented as a personal alert device, such as for incorporation within headsets, walkie-talkies, pagers, and the like. Incursion receiver unit 24 is shown for providing both audio and light output, although other forms of feedback may be additionally or alternatively provided, such as physical output (i.e. "pop-up" flags, and so forth), or vibratory feedback that by way of example may be generated by activating an off-balance electrical motor in a similar manner to those utilized in personal pagers.

Incursion receiver unit 24 is exemplified with a self-contained source of power, such as battery 76 and a power regulator 78, although it will be appreciated that power may be alternatively provided by other sources of power, including existing power supplies within vehicles or other equipment. A receiver circuit 80 connected to receiver antenna 28 is configured for receiving the RF transmissions, from one or more of the incursion transceiver units, and communicating that received information to a controller 82.

Incursion receiver unit 24 may be implemented as an area alerting device (i.e. master receiver) for alerting a group of persons within the vicinity, or as a personal alert device which is retained proximal to one or more individuals. For example, an area alert device may be mounted on a stand or otherwise positioned to increase visibility and to promote optimum sound disbursement. It should also be appreciated that newer phased sound generation techniques may be utilized as desired for directing sounds along specific directions from either area alert devices or personal alert devices. Personal alert devices may be implemented in a number of ways, three preferred forms being a headphone, walkie-talkie, and pager style units. The personal headphone device attenuates work site related noise, while still annunciating alerts within the ear cups, or ear bud, in response to receipt of radio transmitted incursion events. A walkie-talkie unit may be implemented that provides generally conventional walkie-talkie features, such as for communicating between locations at or near the work site, with an annunciator (i.e. vibratory, sound, and/or light) configured for alerting the user to a detected incursion. A personal alert device may also be implemented in a configuration similar to a personal pager unit that generates sound, optional light output, or vibratory feedback in response to an alert being received. Any form of personally carried alert device may also be configured for generating an area alert. It should also be appreciated that these approaches may be combined to suit any specific construction situation depending on the operations performed and the anticipated ambient conditions.

The personal alerts may be configured to receive the radio signals directly from the incursion transceivers or to receive a signal generated by a master receiver located nearby. It will be appreciated that a transmitter unit, on the same or a different frequency as the incursion transmitters which report to the master receiver, may be integrated into the master receiver wherein received alerts are retransmitted for generating an alert annunciated on the personal alert devices. One advantage of transmitting the alerts on a single frequency with a single code from the master receiver is that the personal alert devices need not be configured for multi-channel, or multicode, operation and any risk of incorrectly setting the personal alert devices is eliminated.

The incursion receiver unit may be designed to indiscriminately respond to all valid codes, and/or frequencies, by generating an alert annunciation. Alternatively, a code or set of codes may be adjusted on a code input selector 84 to select which codings, or frequencies, to which the receiver will respond. Although a typical system setup may involve generating an alert in response to a single set of incursion transceivers, it should be appreciated that multiple sets of incursion devices may be utilized for indicating different directions, distances, and so forth. Additionally, by allowing all valid codes or multiple codes to be set within an incursion annunciating receiver, such as the master receiver, added flexibility is provided as transceiver units may be employed at a work site that span multiple group codes. Optionally, the unit may generate different annunciations in response to the different codes. For example, transceivers with a first code may be set up at a distance and the receiver set to generate a first tonal pattern and medium intensity output in response. A second set of transceivers with a second code may be set up on closer approach to the work site, wherein the receiver may be set to generate a second tonal pattern and higher intensity output in response. In this way the present system may be utilized so that it generates any desired set of annunciated responses suitable to the situation being registered.

Annunciations within incursion receiver unit 24 are generated as exemplified by piezoelectric transducer 30 in combination with signaling light 32. The annunciating device preferably enters an idle mode for a predetermined period of time after signaling an alert to prevent redundant alerts. Various forms of annunciation may be provided by the incursion receiver, such as acoustic output, physical output, and/or light output may be provided such as incorporating haptic feedback within personal receiver units (i.e. headphones or pager style units) mounted to an individual (not shown). Incursion receiver unit 24 when configured to generate an wide area acoustic alert may be referred to as a "whooper", "horn alert" or similar terms.

Optionally, the receiver can be configured for displaying and/or annunciating additional information. By way of example, a low battery indicator 86 is shown for indicating the state of the power source for the incursion receiver unit 24, and alternatively for indicating low battery conditions on activated transceiver units. The status of the receiver and or the associated transceivers may also be indicated using a display 88, shown as a simple seven segment display unit, wherein information may be conveyed to and from the users. Furthermore, inputs may be provided for the receiver, such as discrete buttons, switches, keypads, and the like, to set the modes and operating characteristics of the incursion transceiver unit.

Figure 4:
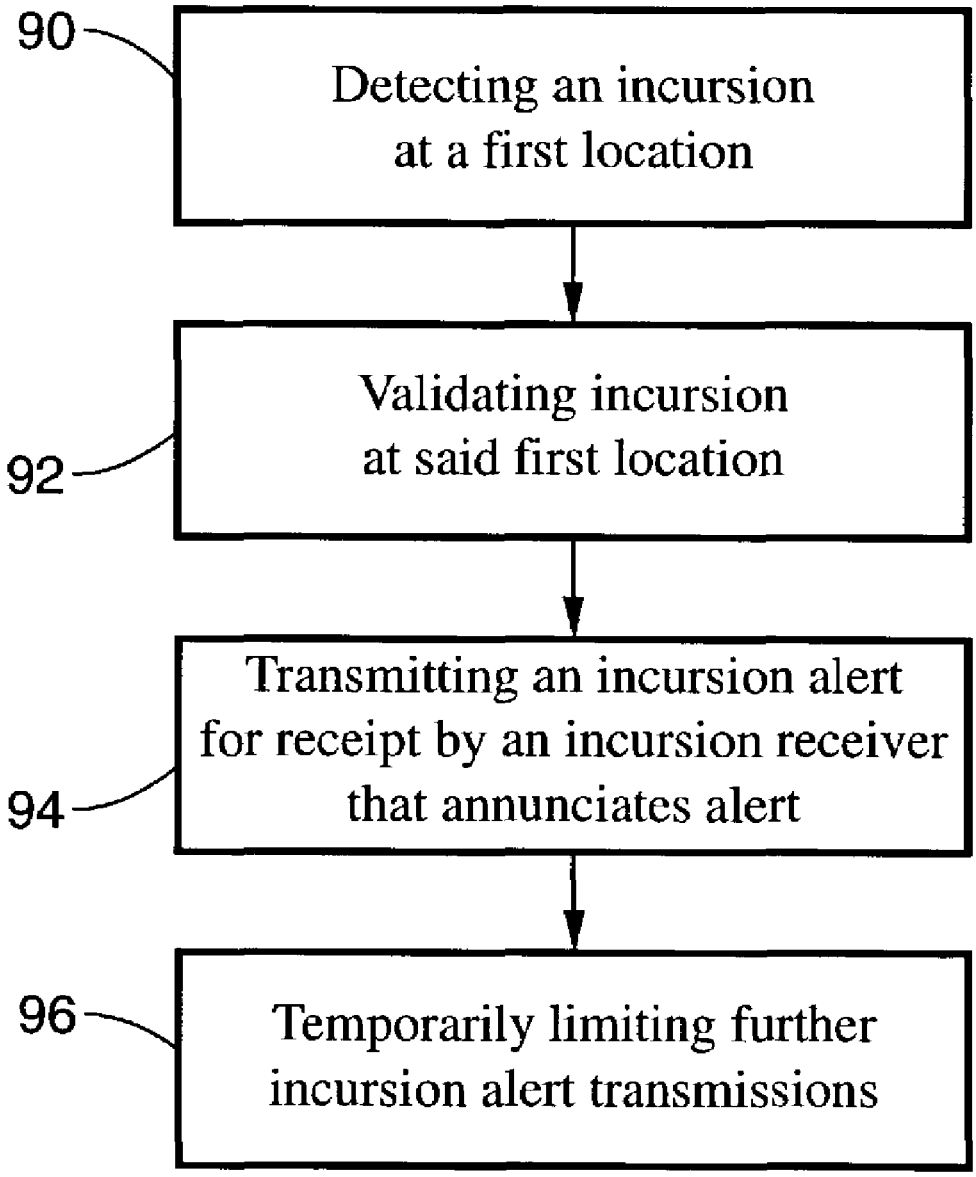
FIG. 4 is a flowchart of system operation for an embodiment of the incursion alerting system according to the present invention.

FIG. 4 exemplifies the method of operation for the incursion alert system of the present invention. An incursion is detected at an incursion transceiver (or transmitter) as represented by block 90 and validated at block 92 to assure that wind, temperature, or other non-hazardous situations do not result in alert generation. Validated incursions are then transmitted as depicted by block 94 for receipt by an incursion receiver configured to alert personnel to the incursion by annunciating the alert using light, sound, haptic output, or combinations thereof. Once an alert is sent by an incursion transceiver, the transceiver preferably enters a temporary transmission lockout period, as represented by block 96, to prevent continuous alert generation from occurring. It will be appreciated by one of ordinary skill in the art that other mechanisms may be alternatively utilized for breaking the feedback situation that may otherwise lead to continuous alerts being generated.

Figure 5:
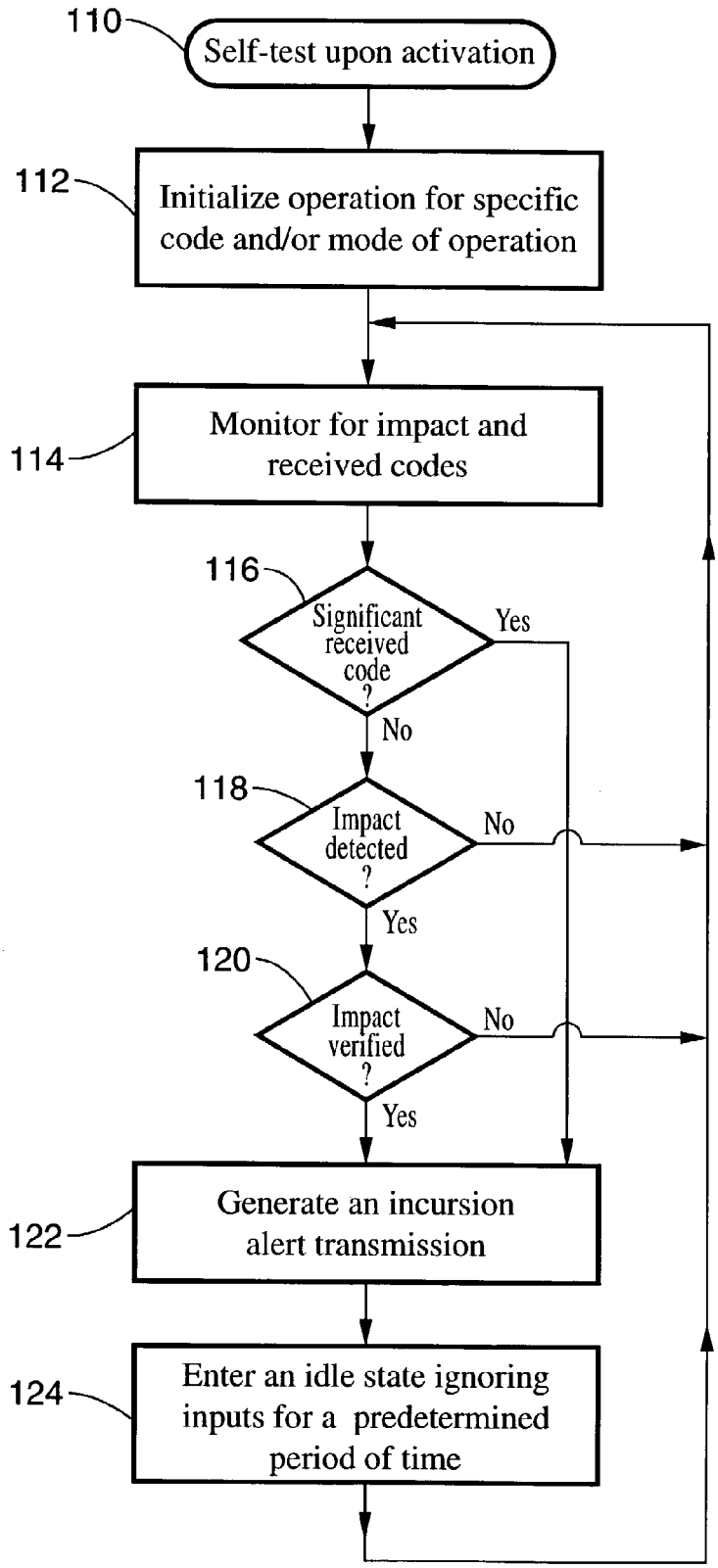
FIG. 5 is a flowchart of operation for an embodiment of the incursion transceiver according to the present invention.

FIG. 5 exemplifies the operation of a control program executing within the controller of an incursion transceiver unit. Upon power up, a unit self-test is performed as represented by block 110, followed by initialization of the unit and performing any needed configurations prior to entering an operational state. It is preferred that the initialization phase of the transceiver span a period of time on the order of from two seconds to twenty seconds, so that the transceiver unit does not generate an alert while being activated and positioned upon a roadway icon. A self-test sequence need not be incorporated within the transceiver units, however, its inclusion can easily increase the reliability of incursion detection as setup at a work site.

Once operational, the incursion transceiver monitors for impacts and coded alerts received from other transceiver units as represented by block 114. If a coded alert is received, as detected by block 116, then the unit generates an incursion alert as per block 122, by retransmitting the alert with the proper code setting. If a coded alert is not received, a check for a sufficient impact intensity is performed at block 118, which upon being satisfied is verified at block 120. Upon verifying impact a message is communicated by way of an alert transmission represented at block 122 to other incursion transceiver units and to a master receiver if it is within transmission range.

Typically, the transmissions from an incursion transceiver (or transmitter) will be directly received by an associated master receiver, however, this can not be assumed as in many situations a remote safety icon may be located outside of the direct reception range of the receiver. Insufficient range typically arise as a result of obstacles being located or positioned between the incursion transmitter and receiver, for example terrain, vehicles, or worksite equipment. After generating an alert, the transceiver unit enters a mode to prevent continuous alerts, depicted by entering an idle state as per block 124, thereby allowing all transmitters to return to idle mode prior to a subsequent alert being generated.

It should be appreciated that alternative or additional forms of incursion sensing may be utilized to suit a variety of applications. For example, additional physical and/or sensing elements may be utilized with an incursion transceiver unit to extend its physical incursion sensing range. Incursion may be detected in the space between safety icons (i.e. traffic cones or posts) by connecting a safety icon, by either a physical or non-physical connection, to a transceiver unit. It will be appreciated that ropes, nets, gates, and other physical structures may be attached between an incursion transceiver unit to a fixed point or to another incursion transceiver unit. Impact with the physical extensions is physically transmitted to the incursion detection transceiver and communicated to the remote receiver device.

Furthermore, additional sensors may be fitted to the incursion transceiver to allow detecting incursion over a large area, such as by utilizing pressure sensitive extension tubes, or pads, that sense pressure as would occur when a car attempts to drive between safety icons. One embodiment of these could be implemented in a similar form factor as a Bot's dot, wherein it transmits an incursion alert in response to being driven over. The embodiment may be implemented by incorporating a flexing piezoelectric element for generating operating power to an encoder and transmitter in response to the flexure of being driven over. It will be noted that although the unit may be self-powered in response to an incursion, it would generally require an additional or different power source if alert signal repetition is desired.

Figure 6:
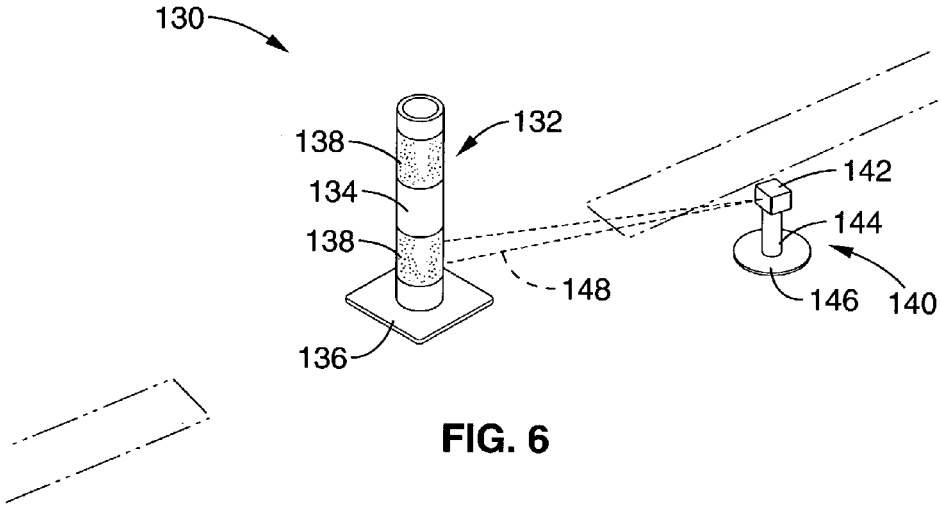
FIG. 6 is a diagram of a safety icon whose movement is detected by a transceiver unit according to an embodiment of the present invention, shown utilizing a light beam for detecting motion within the cone.

FIG. 6 exemplifies a form of remote sensing 130, wherein a safety icon, shown as a traffic post 132, is monitored for motion associated with an incursion event by an incursion detection unit 140. Traffic post 132 is depicted with a vertical member 134 attached to a base 136. Optically responsive materials, such as reflector strips 138, are optionally joined to the exterior of the safety icon to improve optically sensed motion detection.

An incursion event is detected within this embodiment in response to changes in the optical properties along at least one optical pathway. Optical energy, such as a visible light beam (i.e. from a laser source), is directed from the incursion detector unit along a path wherein changes in the levels of reflected energy are detected. The change in reflection may comprise the lack of reflection from a target area in response to vehicle incursion between or upon the target. Alternatively, if the beam is directed to a low reflectivity area (i.e.

absence of a nearby reflective target), the device can sense increased reflections in response to a vehicle making an incursion. The device can be configured to detect reflected energy changes wherein it can detect either form of optical event.

An incursion detection unit 140 is shown with an optical sensing head 142 coupled to a vertical stand member 144 connected to base 146. It will be recognized that the optical sensing head may be positioned in a number of ways, or attached to existing equipment, signage, and so forth, wherein vertical member 144, and base 146 would not be necessary. An optical beam 148 is generated and directed by sense head 142 toward the safety icon 132, wherein motion of the safety icon in response to impacts associated with incursion event are sensed by the varying optical signal response detected by the sense head 142. Verified incursion events are transmitted to a remote annunciation unit. It will be appreciated that sense head 142 may also include an annunciator for broadcasting the event. It should be noted that sense head 142 may be placed a significant distance from the safety icon, or other target, if a highly collimated light source and sensitive optical detector are utilized within the sense head for detecting reflected light. Furthermore, sense head 142 is capable of detecting incursions of vehicles between the remote target 132 (i.e. traffic post) and sense head 142.

Figure 7:
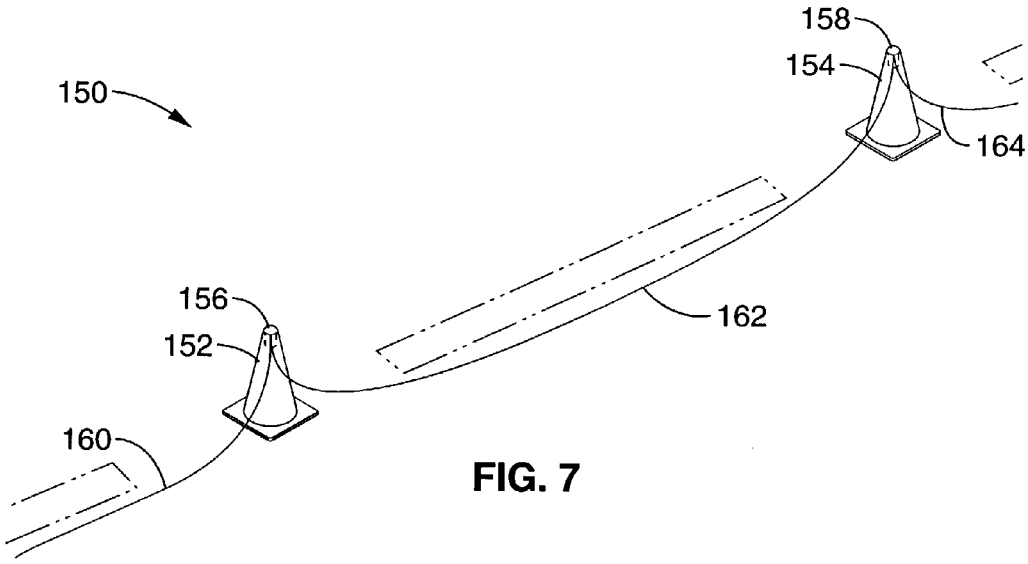
FIG. 7 is a diagram of incursion detection units in a wired configuration according to an aspect of the present invention, shown with detector units attached to the top of traffic cones.

FIG. 7 exemplifies the use of wired incursion detection devices 150 joined to traffic safety structures. Communication of a detected incursion event has been described in detail in the preceding sections over a wireless communication media, however, it should be appreciated that a communication may alternatively occur over a wired communication media. A series of safety icons 152, 154, herein depicted as traffic cones, are shown configured with incursion detectors 156, 158 respectively, which are connected, such as in a daisy-chain configuration, via wiring segments 160, 162, and 164. Incursions registered by any of the incursion detectors 156, 158 are communicated over the wiring to a remote annunciator. Incursion may be detected in response to impact, or motion, of the safety icon 152, 154 as registered on incursion detectors 156, 158. It should be recognized that aspects of the above wired incursion detectors may be combined with aspects and features of the invention as described previously.

Accordingly, it will be seen that this invention provides a method for generating alert annunciations to personnel at a roadside construction site, or similar location, in response to incursions or other impact related events.

Although the description above contains much specificity it should not be construed as limiting the scope of the invention but as merely providing illustrations of some of the presently preferred embodiments of this invention. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. An apparatus for alerting personnel to remote traffic incursion events, comprising:

detecting means for detecting an incursion event;

transmitting means for transmitting an alert signal for remote annunciation in response to detection of an incursion event by said detecting means; and power activation means for activating power to said apparatus in response to sensing of a minimum level of ambient light and maintaining power to said apparatus until said sensed ambient light falls below a minimum level for a predetermined period of time.

2. An apparatus as recited in claim 1, wherein said detecting means and said transmitting means are coupled to a housing configured for attachment to a structure positioned proximal to a roadway.

3. An apparatus as recited in claim 1, wherein said detecting means and said transmitting means are coupled to a housing configured for attachment to, or integration within, a safety icon.

4. An apparatus as recited in claim 3, wherein said safety icon comprises a device utilized for controlling the direction and speed of traffic.

5. An apparatus as recited in claim 3, wherein said safety icon is selected from the group of safety icons consisting essentially of traffic cones, traffic posts, safety barricades, safety barrels, safety nets, and safety fences.

6. An apparatus as recited in claim 1, wherein said detecting means comprises an impact detector which generates an output signal in response to incursion induced impact and further comprising a validation circuit configured for detecting an incursion event by detecting the difference between a wind blown disturbance and an impact disturbance.

7. An apparatus as recited in claim 6, wherein said impact detector is selected from the group of sensors consisting essentially of pressure sensors, impact sensors, tilt sensors, motion sensors, force sensors, speed sensors, distance sensors, rate of rotation sensors, vibration sensors, or acceleration sensors.

8. An apparatus as recited in claim 7, wherein said sensor comprises a switch.

9. An apparatus as recited in claim 7, wherein said sensor comprises a piezoelectric sensor.

10. An apparatus as recited in claim 1, wherein said detecting means comprises an optical detector configured to generate a signal in response to detected changes in the optical properties along at least one optical pathway.

11. An apparatus as recited in claim 1, wherein said transmitting means comprises a transmitter circuit.

12. An apparatus as recited in claim 1, further comprising:

forwarding means for forwarding an alert signal received from another alert apparatus.

13. An apparatus as recited in claim 12, wherein said forwarding means comprises;

a receiver configured for receiving an alert signal from another alert apparatus and communicating said alert signal to said transmitting means for retransmission; and means for locking out said receiver for a predetermined period of time upon retransmission of said alert signal.

14. An apparatus as recited in claim 11, wherein said transmitter circuit is configured to transmit said alert signal for remote annunciation over a wired connection or over a wireless communication link.

15. An apparatus as recited in claim 14, wherein said transmitter circuit is configured to transmit said alert signal within the electromagnetic spectrum over a wireless communication link.

16. An apparatus as recited in claim 15, wherein said transmitter circuit is configured to transmit radio-frequency waves.

17. An apparatus as recited in claim 11, wherein said transmitter circuit comprises a transmitter configured for transmitting acoustic signals.

18. An apparatus as recited in claim 10, further comprising:

encoding means for encoding a data code within said alert signal being transmitted.

19. An apparatus as recited in claim 17, wherein said encoding means comprises a circuit configured to encode a unit identifier, a unit type specifier, or a transmitter group designation.

20. An apparatus for generating incursion alerts for receipt by remote receiving devices that annunciate the alerts to personnel, comprising:

an impact detector configured to generate an alert signal in response to impact;

a transmitter configured for transmitting said alert signal to a remote receiver; and a power switch configured for activating power to said apparatus in response to sensing of a minimum level of ambient light and maintaining power to said apparatus until said sensed ambient light falls below a minimum level for a predetermined period of time.

21. An apparatus as recited in claim 20, wherein said impact detector and said transmitter are coupled to a housing configured for attachment to a structure utilized at a roadway work site.

22. An apparatus as recited in claim 20, wherein said impact detector and said transmitter are coupled to a housing configured for attachment to, or integration within, a safety icon.

23. An apparatus as recited in claim 22, wherein said safety icon comprises a device utilized for controlling the direction and speed of traffic.

24. An apparatus as recited in claim 22, wherein said safety icon is selected from the group of safety icons consisting essentially of traffic cones, traffic posts, safety barricades, safety barrels, safety nets, and safety fences.

25. An apparatus as recited in claim 20, wherein said impact detector is selected from the group of sensors consisting essentially of pressure sensors, impact sensors, tilt sensors, motion sensors, force sensors, speed sensors, distance sensors, rate of rotation sensors, vibration sensors, or acceleration sensors.

26. An apparatus as recited in claim 25, wherein said sensor comprises a piezoelectric sensor.

27. An apparatus as recited in claim 20, wherein said impact detector comprises a switch.

28. An apparatus as recited in claim 20, wherein said transmitter is configured for communicating said alert signal as one or more message codes which provide information about said incursion event.

29. An apparatus as recited in claim 28, wherein said transmitter is configured for communicating non-incursion alert signal message codes for communicating other events to a remote receiver.

30. An apparatus as recited in claim 29, wherein said transmitter is configured for communicating battery condition to a remote receiver.

31. An apparatus as recited in claim 20, further comprising:

encoding means for encoding a data code within said alert signal being transmitted.

32. An apparatus as recited in claim 31, wherein said encoding means comprises a circuit configured to encode a unit identifier, a unit type specifier, or a transmitter group designation.

33. An apparatus as recited in claim 31, wherein said encoding means comprises:

a code generator circuit configured for providing a digital type code, group code, or identifying code associated with said apparatus; and an encoder circuit operably coupled to said code generator circuit and configured for receiving said codes and incorporating them for transmission by said transmitter.

34. An apparatus as recited in claim 33, wherein said encoder circuit is configured for encoding a unique unit identification for said transmitter.

35. An apparatus as recited in claim 20, further comprising;

a validation circuit configured to receive signals from said impact detector and to process those signals to verify that an impact corresponding with an incursion event has occurred prior to generating an alert signal for transmission by said transmitter;

wherein said validation circuit is configured for detecting an incursion event by detecting the difference between a wind blown disturbance and an impact disturbance.

36. An apparatus as recited in claim 20, further comprising:

retransmitting means for retransmitting an alert signal received from a first alert apparatus to a second alert apparatus for extending communication range of said alert signal.

37. An apparatus as recited in claim 36, wherein said retransmitting means comprises:

a receiver configured for receiving an alert signal from said first alert apparatus and communicating said alert signal to said transmitter for retransmission to said second alert apparatus; and means for locking out said receiver for a predetermined period of time upon retransmission of said alert signal.

38. An apparatus for generating an incursion alert for remotely warning roadway personnel to an incursion risk, comprising:

an impact detector configured to generate an incursion event signal in response to impact;

a transmitter coupled to said impact detector and configured for transmitting said incursion alert signal to a remote receiver for annunciation of said impact; and a receiver coupled to said transmitter;

wherein said receiver is configured to receive alert signals from one or more remote transmitters and pass received alert signals to said transmitter for retransmission to one or more remote receivers to extend the transmission range of said one or more remote transmitters;

means for locking out said receiver for a predetermined period of time upon retransmission of said alert signal; and a power switch configured for activating power to said apparatus in response to sensing of a minimum level of ambient light and maintaining power to said apparatus until said sensed ambient light falls below a minimum level for a predetermined period of time.

39. An apparatus as recited in claim 38, wherein said annunciation is in the form of a warning selected from the group consisting essentially of an audible warning, a visual warning, and a tactile warning.

40. An apparatus as recited in claim 38, wherein said transmitters and said receivers are configured to communicate at frequencies within the electromagnetic spectrum.

41. An apparatus as recited in claim 38, further comprising:

encoding means for encoding a data code within said alert signal being transmitted.

42. An apparatus as recited in claim 41, wherein said encoding means comprises a circuit configured to encode a unit identifier, a unit type specifier, or a transmitter group designation.

43. An apparatus as recited in claim 38, wherein said impact detector, said transmitter and said receiver are coupled to a housing configured for attachment to a roadway structure or safety icon.

44. An apparatus as recited in claim 43, wherein said safety icon is selected from the group of safety icons consisting essentially of traffic cones, traffic posts, safety barricades, safety barrels, safety nets, and safety fences.

45. An apparatus as recited in claim 38, further comprising a validation circuit configured for detecting an incursion event by detecting the difference between a wind blown disturbance and an impact disturbance.

46. An apparatus for alerting personnel to remote traffic incursion events, comprising:

means for detecting an incursion event and generating an incursion signal;

a validation circuit configured to filter out an incursion signal for a non-incursion event;

means for transmitting an alert signal for remote annunciation in response to an incursion signal from said validation circuit; and power activation means for activating power to said apparatus in response to sensing of a minimum level of ambient light and maintaining power to said apparatus until said sensed ambient light falls below a minimum level for a predetermined period of time.

47. An apparatus as recited in claim 46, wherein said detecting means comprises a piezoelectric sensor.

48. An apparatus as recited in claim 47, wherein said piezoelectric sensor is configured to generate a voltage signal when detecting an impact.

49. An apparatus as recited in claim 46, wherein said validation circuit is further configured for detecting an incursion event by detecting the difference between a wind blown disturbance and an impact disturbance.

50. An apparatus as recited in claim 46, wherein said validation circuit is further configured for frequency filtering of non-incursion events detected by said means for detecting.

51. An apparatus as recited in claim 46, wherein said transmitting means comprises a transmitter.

52. An apparatus as recited in claim 46, wherein said apparatus further comprises:

a receiver configured to receive an alert signal from another incursion alert apparatus and communicate said alert signal to said transmitter for retransmission; and means for locking out said receiver for a predetermined period of time upon retransmission of said alert signal.

53. An apparatus for alerting personnel to remote traffic incursion events, comprising:

means for detecting an incursion event and generating an impact signal;

means for transmitting an alert signal for remote annunciation in response to said impact signal; and an automatic power switch configured to activate said apparatus in response to sensing of a minimum level of ambient light and maintaining power to said apparatus until said sensed ambient light falls below a minimum level for a predetermined period of time.

54. An apparatus as recited in claim 53, wherein said transmitting means comprises a transmitter.

55. An apparatus as recited in claim 53, wherein said detecting means comprises a piezoelectric sensor.

56. An apparatus as recited in claim 55, wherein said piezoelectric sensor is configured to generate a voltage signal when detecting an impact.

57. An apparatus as recited in claim 53, wherein said detecting means further comprises a validation circuit configured to receive an impact signal from said means for detecting and to process said impact signal to verify that an impact corresponding with an incursion event has occurred prior to communicating said impact signal to said means for transmitting.

58. An apparatus as recited in claim 57, wherein said validation circuit is further configured for detecting an incursion event by detecting the difference between a wind blown disturbance and an impact disturbance.

59. An apparatus as recited in claim 57, wherein said validation circuit is further configured for frequency filtering of non-incursion events detected by said means for detecting.

60. An apparatus as recited in claim 53, wherein said apparatus further comprises:

a receiver configured to receive an alert signal from another incursion alert apparatus and communicate said alert signal to said transmitting means for retransmission; and means for locking out said receiver for a predetermined period of time upon retransmission of said alert signal.

* * * * *